US009583828B2

(12) United States Patent
Kasher et al.

(10) Patent No.: US 9,583,828 B2
(45) Date of Patent: Feb. 28, 2017

(54) APPARATUS, SYSTEM AND METHOD OF CONTROLLING ONE OR MORE ANTENNAS OF A MOBILE DEVICE

(71) Applicant: Intel Corporation, Santa Clara, CA (US)

(72) Inventors: Assaf Kasher, Haifa (IL); Michael Glik, Kfar Saba (IL); Ofir Artstain, Netanya (IL)

(73) Assignee: INTEL CORPORATION, Santa Clara, CA (US)

( * ) Notice: Subject to any disclaimer, the term of this patent is extended or adjusted under 35 U.S.C. 154(b) by 811 days.

(21) Appl. No.: 13/707,106

(22) Filed: Dec. 6, 2012

(65) Prior Publication Data

US 2014/0159957 A1 Jun. 12, 2014

(51) Int. Cl.

| | |
|---|---|
| ***H01Q 3/02*** | (2006.01) |
| ***H01Q 3/00*** | (2006.01) |
| ***H01Q 1/24*** | (2006.01) |
| ***H01Q 3/24*** | (2006.01) |
| ***H01Q 21/29*** | (2006.01) |

(52) U.S. Cl.

CPC ..... *H01Q 3/00* (2013.01); *H01Q 1/243* (2013.01); *H01Q 3/24* (2013.01); *H01Q 21/29* (2013.01)

(58) Field of Classification Search

CPC H01Q 3/00; H01Q 3/24; H01Q 1/243; H01Q 21/29

USPC ..... 342/374

See application file for complete search history.

(56) References Cited

U.S. PATENT DOCUMENTS

| | | | | |
|---|---|---|---|---|
| 5,300,935 | A | 4/1994 | Yu | |
| 5,649,306 | A | 7/1997 | Vannatta et al. | |
| 6,281,839 | B1 * | 8/2001 | Nielsen | H01Q 1/18 342/372 |
| 6,311,075 | B1 | 10/2001 | Bevan et al. | |
| 8,230,075 | B1 | 7/2012 | Weskamp et al. | |
| 2002/0106995 | A1 * | 8/2002 | Callaway, Jr. | H01Q 1/241 455/101 |
| 2003/0232598 | A1 | 12/2003 | Aljadeff et al. | |
| 2005/0192056 | A1 | 9/2005 | Karaki | |
| 2006/0007041 | A1 * | 1/2006 | Oomuro | H01Q 1/246 342/368 |
| 2006/0240866 | A1 | 10/2006 | Eilts | |

(Continued)

FOREIGN PATENT DOCUMENTS

| | | |
|---|---|---|
| EP | 1360857 | 11/2003 |
| JP | 2004356739 | 12/2004 |

(Continued)

OTHER PUBLICATIONS

International Preliminary Report on Patentability for PCT Application No. PCT/US2011/048658, mailed on Mar. 6, 2014, 6 pages.

(Continued)

*Primary Examiner* — Frank J McGue
(74) *Attorney, Agent, or Firm* — Shichrur & Co.

(57) ABSTRACT

Some demonstrative embodiments include apparatuses, devices, systems and/or methods for controlling an antenna scheme of one or more antennas. For example, a controller may be configured to control an antenna scheme of one or more antennas of a mobile device for wireless communication based on a position of a lid of the mobile device relative to a base of the mobile device.

22 Claims, 4 Drawing Sheets

(56) References Cited

U.S. PATENT DOCUMENTS

| | | | | |
|---|---|---|---|---|
| 2006/0287085 | A1 | 12/2006 | Mao et al. | |
| 2007/0263578 | A1 | 11/2007 | Nakaso et al. | |
| 2008/0024363 | A1* | 1/2008 | Van Toorenburg | G01S 19/36 342/357.25 |
| 2008/0311957 | A1 | 12/2008 | Jantunen et al. | |
| 2009/0156235 | A1 | 6/2009 | Johansson et al. | |
| 2009/0295648 | A1* | 12/2009 | Dorsey | H01Q 1/2266 343/702 |
| 2009/0303204 | A1 | 12/2009 | Nasiri et al. | |
| 2010/0333043 | A1 | 12/2010 | Faris et al. | |
| 2012/0058783 | A1 | 3/2012 | Kim et al. | |
| 2012/0071151 | A1 | 3/2012 | Abramson et al. | |
| 2012/0105720 | A1 | 5/2012 | Chung et al. | |
| 2012/0122400 | A1 | 5/2012 | Kitagawa et al. | |
| 2012/0256959 | A1 | 10/2012 | Ye et al. | |
| 2012/0265528 | A1 | 10/2012 | Gruber et al. | |
| 2013/0065648 | A1 | 3/2013 | Kim et al. | |
| 2013/0069969 | A1 | 3/2013 | Chang et al. | |
| 2013/0084981 | A1 | 4/2013 | Zalewski et al. | |
| 2013/0151195 | A1 | 6/2013 | Marinoni | |
| 2013/0238455 | A1 | 9/2013 | Laracey | |
| 2014/0118254 | A1 | 5/2014 | Fei et al. | |
| 2014/0125575 | A1 | 5/2014 | Singhar | |
| 2014/0140426 | A1 | 5/2014 | Dinur et al. | |
| 2014/0148193 | A1 | 5/2014 | Kogan et al. | |

FOREIGN PATENT DOCUMENTS

| | | | |
|---|---|---|---|
| JP | 2006295622 | | 10/2006 |
| JP | 2007274518 | | 10/2007 |
| KR | 2003-0058098 | A | 7/2003 |
| KR | 10-2009-0074814 | A | 7/2009 |
| WO | 2013028171 | | 2/2013 |

OTHER PUBLICATIONS

Office Action for U.S. Appl. No. 13/688,425, mailed on Feb. 9, 2015, 33 pages.
Supplementary Partial European Search Report for European Patent Application No. 11871311.4, mailed on Apr. 8, 2015, 6 pages.
Office Action for U.S. Appl. No. 13/976,057, mailed on Apr. 23, 2015, 29 pages.
Notice of Allowance for U.S. Appl. No. 13/688,425, mailed on Jun. 8, 2015, 10 pages.
International Preliminary Report on Patentability and Written Opinion for International Patent Application No. PCT/US2013/047733, mailed on Jun. 11, 2015, 8 pages.
Extended European Search Report for European Patent Application No. 11871311.4, mailed on Jul. 27, 2015, 10 pages.
International Search Report and Written Opinion for PCT Patent Application No. PCT/US2013/047733, mailed on Sep. 30, 2013, 12 pages.
International Search Report and Written Opinion for PCT Patent Application No. PCT/US2013/048087, mailed on Sep. 26, 2013, 13 pages.
Wireless-Gigabit-Alliance (WGA) specifications (Wireless Gigabit Alliance, Inc WiGig MAC and PHY Specification Version 1.0, Final specification), Apr. 2010.
IEEE Std 802.11™-2012. Part 11: Wireless LAN Medium Access Control (MAC) and Physical Layer (PHY) Specifications, IEEE Standard for Information technology. Telecommunications and information exchange between systems Local and metropolitan area networks—Specific requirements, Mar. 29, 2012.
International Search Report and Written Opinion for PCT application PCT/US2011/048658 mailed on Feb. 21, 2012.
Office Action for U.S. Appl. No. 13/976,057, mailed on Nov. 3, 2015, 23 pages.
Notice of Allowance for U.S. Appl. No. 13/976,057, mailed on Apr. 22, 2016, 15 pages.

* cited by examiner

APPARATUS, SYSTEM AND METHOD OF CONTROLLING ONE OR MORE ANTENNAS OF A MOBILE DEVICE

BACKGROUND

A mobile device, e.g., a laptop computer, a notebook computer, an Ultrabook computer, a tablet computer, a tablet personal computer (PC) or the like, may be able to communicate via one or more antennas.

The mobile device may include a base and a lid. For example, the base may include, a keyboard, a hard disk drive, and/or a touch pad, and/or the lid may include a display, a touch screen, and/or webcam.

The lid may be movable between two or more positions with respect to the base.

In a first example, the lid may be movable between an open position, e.g., when the lid is at an angle of about 90 degrees with respect to the base, and a closed position, e.g., when the lid is at an angle of about zero degrees with respect to the base.

In a second example, the lid may be movable between the open position and a detached position ("tablet position"), in which the lid is detached from the base.

In a third example, the lid may be movable between the open position, and a folded position ("tablet PC position"), in which the lid is folded over the base.

BRIEF DESCRIPTION OF THE DRAWINGS

For simplicity and clarity of illustration, elements shown in the figures have not necessarily been drawn to scale. For example, the dimensions of some of the elements may be exaggerated relative to other elements for clarity of presentation. Furthermore, reference numerals may be repeated among the figures to indicate corresponding or analogous elements. The figures are listed below.

DETAILED DESCRIPTION

Figure 1:
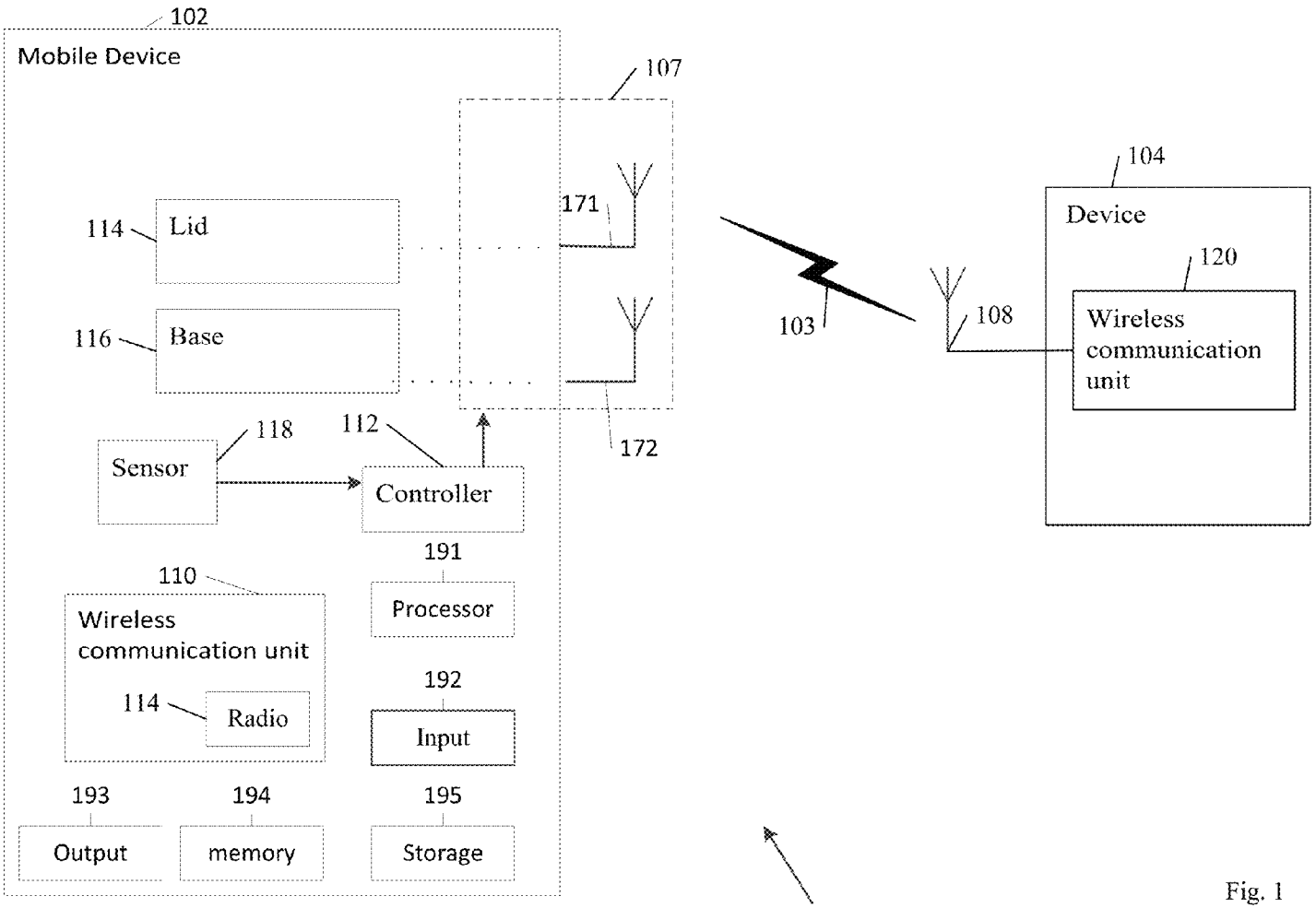
FIG. 1 is a schematic block diagram illustration of a system, in accordance with some demonstrative embodiments.

In the following detailed description, numerous specific details are set forth in order to provide a thorough understanding of some embodiments. However, it will be understood by persons of ordinary skill in the art that some embodiments may be practiced without these specific details. In other instances, well-known methods, procedures, components, units and/or circuits have not been described in detail so as not to obscure the discussion.

Discussions herein utilizing terms such as, for example, "processing", "computing", "calculating", "determining", "establishing", "analyzing", "checking", or the like, may refer to operation(s) and/or process(es) of a computer, a computing platform, a computing system, or other electronic computing device, that manipulate and/or transform data represented as physical (e.g., electronic) quantities within the computer's registers and/or memories into other data similarly represented as physical quantities within the computer's registers and/or memories or other information storage medium that may store instructions to perform operations and/or processes.

The terms "plurality" and "a plurality", as used herein, include, for example, "multiple" or "two or more". For example, "a plurality of items" includes two or more items.

References to "one embodiment", "an embodiment", "demonstrative embodiment", "various embodiments" etc., indicate that the embodiment(s) so described may include a particular feature, structure, or characteristic, but not every embodiment necessarily includes the particular feature, structure, or characteristic. Further, repeated use of the phrase "in one embodiment" does not necessarily refer to the same embodiment, although it may.

As used herein, unless otherwise specified the use of the ordinal adjectives "first", "second", "third" etc., to describe a common object, merely indicate that different instances of like objects are being referred to, and are not intended to imply that the objects so described must be in a given sequence, either temporally, spatially, in ranking, or in any other manner.

Some embodiments may be used in conjunction with various devices and systems, for example, a Personal Computer (PC), a desktop computer, a mobile computer, a laptop computer, a notebook computer, a tablet computer, an Ultrabook™ computer, a server computer, a handheld computer, a handheld device, a Personal Digital Assistant (PDA) device, a handheld PDA device, an on-board device, an off-board device, a hybrid device, a vehicular device, a non-vehicular device, a mobile or portable device, a consumer device, a non-mobile or non-portable device, a wireless communication station, a wireless communication device, a wireless Access Point (AP), a wired or wireless router, a wired or wireless modem, a video device, an audio device, an audio-video (AN) device, a wired or wireless network, a wireless area network, a Wireless Video Area Network (WVAN), a Local Area Network (LAN), a Wireless LAN (WLAN), a Personal Area Network (PAN), a Wireless PAN (WPAN), and the like.

Some embodiments may be used in conjunction with devices and/or networks operating in accordance with existing Wireless-Gigabit-Alliance (WGA) specifications (Wireless Gigabit Alliance, Inc WiGig MAC and PHY Specification Version 1.1, April 2011, Final specification) and/or future versions and/or derivatives thereof, devices and/or networks operating in accordance with existing IEEE 802.11 standards (IEEE 802.11-2012, IEEE Standard for Information technology—Telecommunications and information exchange between systems Local and metropolitan area networks—Specific requirements Part 11: Wireless LAN Medium Access Control (MAC) and Physical Layer (PHY) Specifications, Mar. 29, 2012; IEEE802.11 task group ac (TGac) ("IEEE802.11-09/0308r12—TGac Channel Model Addendum Document"); IEEE 802.11 task group ad (TGad) (IEEE P802.11ad Standard for Information Technology—

Telecommunications and Information Exchange Between Systems—Local and Metropolitan Area Networks—Specific Requirements—Part 11: Wireless LAN Medium Access Control (MAC) and Physical Layer (PHY) Specifications—Amendment 3: Enhancements for Very High Throughput in the 60 GHz Band)) and/or future versions and/or derivatives thereof, devices and/or networks operating in accordance with existing WirelessHD™ specifications and/or future versions and/or derivatives thereof, units and/or devices which are part of the above networks, and the like.

Some embodiments may be used in conjunction with one way and/or two-way radio communication systems, cellular radio-telephone communication systems, a mobile phone, a cellular telephone, a wireless telephone, a Personal Communication Systems (PCS) device, a PDA device which incorporates a wireless communication device, a mobile or portable Global Positioning System (GPS) device, a device which incorporates a GPS receiver or transceiver or chip, a device which incorporates an RFID element or chip, a Multiple Input Multiple Output (MIMO) transceiver or device, a Single Input Multiple Output (SIMO) transceiver or device, a Multiple Input Single Output (MISO) transceiver or device, a device having one or more internal antennas and/or external antennas, Digital Video Broadcast (DVB) devices or systems, multi-standard radio devices or systems, a wired or wireless handheld device, e.g., a Smartphone, a Wireless Application Protocol (WAP) device, or the like.

Some embodiments may be used in conjunction with one or more types of wireless communication signals and/or systems, for example, Radio Frequency (RF), Infra Red (IR), Frequency-Division Multiplexing (FDM), Orthogonal FDM (OFDM), Time-Division Multiplexing (TDM), Time-Division Multiple Access (TDMA), Extended TDMA (E-TDMA), General Packet Radio Service (GPRS), extended GPRS, Code-Division Multiple Access (CDMA), Wideband CDMA (WCDMA), CDMA 2000, single-carrier CDMA, multi-carrier CDMA, Multi-Carrier Modulation (MDM), Discrete Multi-Tone (DMT), Bluetooth®, Global Positioning System (GPS), Wi-Fi, Wi-Max, ZigBee™, Ultra-Wideband (UWB), Global System for Mobile communication (GSM), 2G, 2.5G, 3G, 3.5G, Long Term Evolution (LTE), LTE advanced, Enhanced Data rates for GSM Evolution (EDGE), or the like. Other embodiments may be used in various other devices, systems and/or networks.

The term "wireless device", as used herein, includes, for example, a device capable of wireless communication, a communication device capable of wireless communication, a communication station capable of wireless communication, a portable or non-portable device capable of wireless communication, or the like. In some demonstrative embodiments, a wireless device may be or may include a peripheral that is integrated with a computer, or a peripheral that is attached to a computer. In some demonstrative embodiments, the term "wireless device" may optionally include a wireless service.

The term "communicating" as used herein with respect to a wireless communication signal includes transmitting the wireless communication signal and/or receiving the wireless communication signal. For example, a wireless communication unit, which is capable of communicating a wireless communication signal, may include a wireless transmitter to transmit the wireless communication signal to at least one other wireless communication unit, and/or a wireless communication receiver to receive the wireless communication signal from at least one other wireless communication unit.

Some demonstrative embodiments may be used in conjunction with suitable limited-range or short-range wireless communication networks, for example, a wireless area network, a "piconet", a WPAN, a WVAN and the like. Other embodiments may be used in conjunction with any other suitable wireless communication network.

Some demonstrative embodiments may be used in conjunction with a wireless communication network communicating over a frequency band of 60 GHz. However, other embodiments may be implemented utilizing any other suitable wireless communication frequency bands, for example, an Extremely High Frequency (EHF) band (the millimeter wave (mmwave) frequency band), e.g., a frequency band within the frequency band of between 30 Ghz and 300 GHZ, a WLAN frequency band, a WPAN frequency band, a frequency band according to the WGA specification, and the like.

The term "antenna", as used herein, may include any suitable configuration, structure and/or arrangement of one or more antenna elements, components, units, assemblies and/or arrays. In some embodiments, the antenna may implement transmit and receive functionalities using separate transmit and receive antenna elements. In some embodiments, the antenna may implement transmit and receive functionalities using common and/or integrated transmit/receive elements. The antenna may include, for example, a phased array antenna, a single element antenna, a set of switched beam antennas, and/or the like.

The phrases "directional multi-gigabit (DMG)" and "directional band" (DBand), as used herein, may relate to a frequency band wherein the Channel starting frequency is above 40 GHz.

The term "beamforming", as used herein, may relate to a spatial filtering mechanism, which may be used at a transmitter and/or a receiver to improve the received signal power or signal-to-noise ratio (SNR) at an intended receiver.

The phrase "peer to peer (PTP or P2P) communication", as used herein, may relate to device-to-device communication over a wireless link ("peer-to-peer link") between a pair of devices. The P2P communication may include, for example, wireless communication over a direct link within a QoS basic service set (BSS), a tunneled direct-link setup (TDLS) link, a STA-to-STA communication in an independent basic service set (IBSS), or the like.

Reference is now made to FIG. 1, which schematically illustrates a block diagram of a system 100, in accordance with some demonstrative embodiments.

In some demonstrative embodiments, system 100 may include a wireless communication network including one or more wireless communication devices, e.g., wireless communication devices 102 and/or 104, capable of communicating content, data, information and/or signals over a wireless communication link 103, for example, over a radio channel, an IR channel, a RF channel, a Wireless Fidelity (WiFi) channel, and the like. One or more elements of system 100 may optionally be capable of communicating over any suitable wired communication links.

In some demonstrative embodiments, devices 102 and/or 104 may include a wireless communication unit capable of communicating over wireless communication link 103. For example, device 102 may include a wireless communication unit 110, and device 104 may include a wireless communication unit 120.

In some demonstrative embodiments, wireless communication units 110 and/or 120 may include, for example, one or more radios, e.g., a radio 114. For example, radio 114 may include one or more wireless transmitters, receivers and/or transceivers able to send and/or receive wireless communication signals, RF signals, frames, blocks, transmission streams, packets, messages, data items, and/or data. For example, wireless communication units 110 and/or 120 may include or may be implemented as part of a wireless Network Interface Card (NIC), and the like.

In some demonstrative embodiments, wireless communication units 110 and 120 may include, or may be associated with, one or more antennas 107 and 108, respectively. Antennas 107 and 108 may include any type of antennas suitable for transmitting and/or receiving wireless communication signals, blocks, frames, transmission streams, packets, messages and/or data. For example, antennas 107 and 108 may include any suitable configuration, structure and/or arrangement of one or more antenna elements, components, units, assemblies and/or arrays. Antennas 107 and 108 may include, for example, antennas suitable for directional communication, e.g., using beamforming techniques. For example, antennas 107 and 108 may include a phased array antenna, a single element antenna, a set of switched beam antennas, and/or the like. In some embodiments, antennas 107 and 108 may implement transmit and receive functionalities using separate transmit and receive antenna elements. In some embodiments, antennas 107 and 108 may implement transmit and receive functionalities using common and/or integrated transmit/receive elements In some demonstrative embodiments, device 102 may include, or may be included as part of a mobile or portable device, for example, a mobile computer, a laptop computer, a notebook computer, a tablet, an Ultrabook™, a tablet PC, a Smartphone, a handheld computer, a handheld device, a PDA device, a handheld PDA device, a hybrid device (e.g., combining cellular phone functionalities with PDA device functionalities), a consumer device, a vehicular device, a cellular telephone, a PCS device, a PDA device which incorporates a wireless communication device, a mobile or portable GPS device, a relatively small computing device, a non-desktop computer, an Ultra Mobile Device (UMD), an Ultra Mobile PC (UMPC), a Mobile Internet Device (MID), an "Origami" device or computing device, a device that supports Dynamically Composable Computing (DCC), a context-aware device, a video device, an A/V device, a Blu-ray disc (BD) player, a Digital Video Disc (DVD) player, a High Definition (HD) DVD player, a Personal Media Player (PMP), a gaming device, a media player, a music player, or the like.

Device 102 may also include, for example, one or more of a processor 191, an input unit 192, an output unit 193, a memory unit 194, and a storage unit 195. Device 102 may optionally include other suitable hardware components and/or software components. In some demonstrative embodiments, some or all of the components of one or more of device 102, may be enclosed in a common housing or packaging, and may be interconnected or operably associated using one or more wired or wireless links. In other embodiments, components of device 102 may be distributed among multiple or separate devices.

Processor 191 includes, for example, a Central Processing Unit (CPU), a Digital Signal Processor (DSP), one or more processor cores, a single-core processor, a dual-core processor, a multiple-core processor, a microprocessor, a host processor, a controller, a plurality of processors or controllers, a chip, a microchip, one or more circuits, circuitry, a logic unit, an Integrated Circuit (IC), an Application-Specific IC (ASIC), or any other suitable multi-purpose or specific processor or controller. Processor 191 executes instructions, for example, of an Operating System (OS) of device 102 and/or of one or more suitable applications.

Input unit 192 includes, for example, a keyboard, a keypad, a mouse, a touch-screen, a touch-pad, a track-ball, a stylus, a microphone, or other suitable pointing device or input device. Output unit 193 includes, for example, a monitor, a screen, a touch-screen, a flat panel display, a Liquid Crystal Display (LCD) display unit, a plasma display unit, one or more audio speakers or earphones, or other suitable output devices.

Memory unit 194 includes, for example, a Random Access Memory (RAM), a Read Only Memory (ROM), a Dynamic RAM (DRAM), a Synchronous DRAM (SD-RAM), a flash memory, a volatile memory, a non-volatile memory, a cache memory, a buffer, a short term memory unit, a long term memory unit, or other suitable memory units. Storage unit 195 includes, for example, a hard disk drive, a floppy disk drive, a Compact Disk (CD) drive, a CD-ROM drive, a DVD drive, or other suitable removable or non-removable storage units. Memory unit 194 and/or storage unit 195, for example, may store data processed by device 102.

In some demonstrative embodiments, device 104 may include a mobile or non-mobile device, e.g., a PC, a notebook, a docking station, a router, an access point (AP), and/or the like.

In some demonstrative embodiments, device 102 may include a base 116, and a lid 114 connected to base 116.

In some demonstrative embodiments, base 116 may include one or more components of device 102, e.g., a battery and/or a keyboard.

In some demonstrative embodiments, lid 114 may be configured to cover base 116, and may include one or more components of device 102, e.g., a display and/or a camera.

In some demonstrative embodiments, lid 114 may be movable between two or more different positions relative to base 116, e.g., as described below.

In some demonstrative embodiments, lid 114 may be movable between an open position and a closed position, for example, if device 102 performs the functionality of a notebook, e.g., as described below with reference to FIGS. 2A and 2B, and/or FIGS. 3A and 3B.

In some demonstrative embodiments, the open position may include a position in which a first angle, e.g., of about ninety-degrees, is formed between lid 114 and base 116. For example, when the lid is at the open position, a user of device 102 may utilize one or more components of device 102, e.g., a display, a keyboard and/or a touchpad.

In some demonstrative embodiments, the closed position may include a position, in which a second angle, e.g., of about zero degrees, is formed between lid 114 and base 116. For example, device 102 may enter an idle state, a standby state, and/or a power save state, when lid 114 is in the closed position. In one example, device 102 may be able to perform one or more processes and/or functionalities, e.g., communicating over wireless link 103, downloading content, and/or the like, when lid 114 is in the closed position.

In some demonstrative embodiments, lid 114 may be movable between the open position and a detached position, for example, if device 102 performs the functionality of a notebook having a detachable display and/or a hybrid laptop-tablet device, e.g., as described below with reference to FIGS. 4A and 4B.

In some demonstrative embodiments, the detached position may include a position, at which lid 114 is detached from base 116. For example, the user of device 102 may carry and utilize lid 114 as a tablet, while base 116 is unused and/or powered down.

In some demonstrative embodiments, lid 114 may be movable between three positions, e.g., the open position, a swivel position, and a folded position, for example, if device 102 performs the functionality of a tablet PC, e.g., as described below with reference to FIGS. 5A, 5B and 5C.

In some demonstrative embodiments, the swivel position may include a position in which lid 114 is perpendicular to base 116 and rotated with respect to an axis perpendicular to base 116. For example, the swivel position may enable a display of lid 114 to be rotated away from a keyboard of base 116.

In some demonstrative embodiments, the folded position may include a position, in which lid 114 is folded over base 116. For example, swivel lid 114 may include a touch screen, an onscreen keyboard, and/or the like, which may enable the user to utilize device 102 as a tablet PC, when lid 114 is folded over base 116.

In some demonstrative embodiments, wireless communication link 103 may include a wireless communication link over the DMG band.

In some demonstrative embodiments, wireless communication link 103 may include a wireless gigabit (WiGig) link. For example, wireless communication link 103 may include a beamformed link, e.g., utilizing any suitable beamforming technique.

In other embodiments, wireless communication link 103 may include any other suitable link and/or may utilize any other suitable wireless communication technology.

In some demonstrative embodiments, wireless communication link 103 may include a direct link, e.g., a P2P link, for example, to enable direct communication between devices 102 and 104.

In some demonstrative embodiments, antennas 107 may include one or more antennas suitable for directional communication, for example, to enable the direct communication and/or the beamformed link between devices 102 and 104.

In some demonstrative embodiments, using the same antenna scheme of antennas 107 for wireless communication for the different positions of lid 114 may not be effective and/or efficient.

For example, device 102 may be able to communicate efficiently with device 104 using an antenna scheme, when lid 114 is at the open position. Device 102 may not be able to communicate efficiently with device 104 using the same antenna scheme, e.g., when lid 114 is at the closed position.

Using the same antenna scheme may not be efficient due to a change in the directionality of antennas 107 resulting from the change of the position of lid 114. The change of directionality may degrade a performance of antennas 107 and/or may not enable device 102 to communicate efficiently with device 104.

In some demonstrative embodiments, device 102 may include a controller 112 to control the antenna scheme of antennas 107, based on the position of lid 114 with respect to base 116, e.g., as described below.

In some demonstrative embodiments, controller 112 may select different antenna schemes of antennas 107 for different positions of lid 114, e.g., as described below.

In some demonstrative embodiments, device 102 may include a sensor 118 configured to sense the position of lid 114 relative to base 116. For example, sensor 118 may include any device, unit, module and/or element capable of sensing, detecting, tracking and/or determining the position of lid 114 and/or base 116, e.g., a mechanical sensor, an optical sensor, an electronic sensor and/or the like.

In some demonstrative embodiments, sensor 118 may indicate to controller 112 the position of lid 114 relative to base 116. For example, sensor 118 may indicate to controller 112 that lid 114 is at the closed position, the open position, the detached position, the folded position, and/or any other position of lid 114 relative to base 116.

In some demonstrative embodiments, controller 112 may select at least one first antenna of antennas 107 for wireless communication, when lid 114 is at a first position, and at least one second antenna of antennas 107 for wireless communication, when lid 114 is at a second position, different from the first position.

In one example, antennas 107 may include at least one first antenna 171 associated with lid 114, e.g., connected to lid 114, housed within lid 114, formed on a surface of lid 114 and/or formed as part of lid 114, and at least one second antenna 172 associated with base 116, e.g., connected to base 116, housed within base 116, formed on a surface of base 116 and/or formed as part of base 116. Controller 112 may select first antenna 171, e.g., when lid 114 is at the open position, and controller 112 may select second antenna 172, e.g., when lid 114 is at the closed position.

In another example, first antenna 171 and second antenna 172 may be associated with any other element of device 102, e.g., both antennas 171 and 172 may be associated with lid 114, or both antennas 171 and 172 may be associated with base 116.

In some demonstrative embodiments, first antenna 171 and second antenna 172 may include antennas of first and second different types. For example, first antenna 171, may include a rectangular array of patch antenna elements, and second antenna 172 may include a linear array of endfire antenna elements, e.g., as described below with reference to FIGS. 2A and 2B.

For example, controller 112 may select first antenna 171 including the rectangular array of patch antenna elements, when lid 114 is at the open position. Controller 112 may select second antenna 172 including the linear array of end-fire antenna elements, when lid 114 is at the closed position.

In some demonstrative embodiments, controller 112 may select different operational modes of at least one antenna of antennas 107 for different positions of lid 114 relative to base 116, e.g., as described below.

In some demonstrative embodiments, controller 112 may select a first operational mode of at least one antenna of antennas 107 for wireless communication, when lid 114 is at a first position, and a second operational mode, different from the first operational mode, when lid 114 is at a second position, different from the first position, e.g., as described below with reference to FIGS. 3A and 3B.

In some demonstrative embodiments, the operational mode of the antenna may include a directionality of the antenna.

For example, antennas 107 may include a rectangular array, e.g., of patch antenna elements, and controller 112 may select a first antenna directionality for the rectangular array, e.g., when lid 114 is at the open state, and a second antenna directionality for the rectangular array, e.g., when lid 114 is at the closed position. In another example, antennas 107 may include any other suitable antenna, e.g., an endfire array of antenna elements.

In other embodiments, the operational mode of the antenna may include any other operational state, e.g., on or off, a transmission power, and/or the like.

In some demonstrative embodiments, the first antenna directionality may include a direction substantially perpendicular to the rectangular antenna array, and the second antenna directionality may include a direction substantially parallel to the rectangular antenna array, e.g., as described below with reference to FIGS. 3A and 3B.

In some demonstrative embodiments, controller 112 may select between one or more antennas of antennas 107, one or more operational states of antennas 107 and/or any combination of one or more antennas of antennas 107 and one or more operational states of the antennas, e.g., when lid 114 is moved between a first position and a second position, different from the first position.

In some demonstrative embodiments, lid 114 may include a detachable lid, e.g., having a functionality of a tablet computer, for example, if device 102 includes a notebook having a detachable display and/or a hybrid laptop-tablet computer.

In some demonstrative embodiments, lid 114 may be movable between the open position and the detached position.

In some demonstrative embodiments, controller 112 may receive from sensor 118 an indication that lid 114 is at the detached position, for example, when lid 114 is detached from base 116.

In some demonstrative embodiments, controller 112 may select between different operational modes of antennas 107, and/or between two or more antennas of antennas 107, e.g., when lid 114 is moved between the open position and the detached position.

For example, controller 112 may select between using first antenna 171 or second antenna 172, and/or controller 112 may select between two or more different operational modes of antennas 171 and/or 172, e.g., as described below with reference to FIGS. 4A and 4B.

In some demonstrative embodiments, lid 114 may include a swivel lid, e.g., configured to be folded over base 116, for example, to provide the functionality of a tablet PC.

In some demonstrative embodiments, lid 114 may be moved between the open position and the folded position.

In some demonstrative embodiments, controller 112 may receive from sensor 118 indication that swivel lid 114 is at the folded position.

In some demonstrative embodiments, controller 112 may select between using first antenna 171 or second antenna 172, and/or controller 112 may select between two or more different operational modes of antennas 171 and/or 172, e.g., when lid 114 is moved between the open position and the folded position.

For example, controller 112 may select between the rectangular array of patch antenna elements and the linear array of endfire antenna elements, e.g., as described below with reference to FIGS. 5A, 5B and 5C.

In some demonstrative embodiments, controlling the antenna scheme of antennas 107 may increase the efficiency of antennas 107, may reduce power consumption of device 102, and/or may increase the performance of device 102.

Figure 2A:
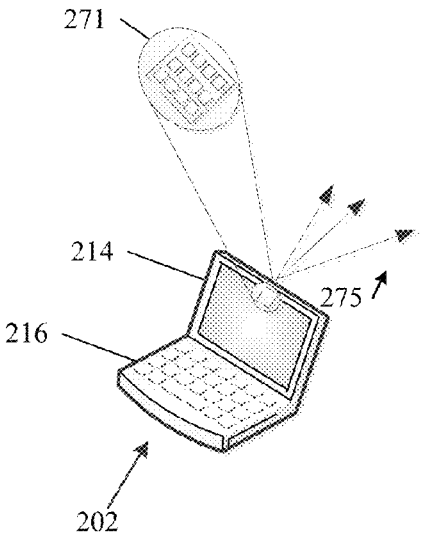
FIGS. 2A and 2B are illustrations of a mobile device in closed and open states, in accordance with some demonstrative embodiments.
Figure 2B:
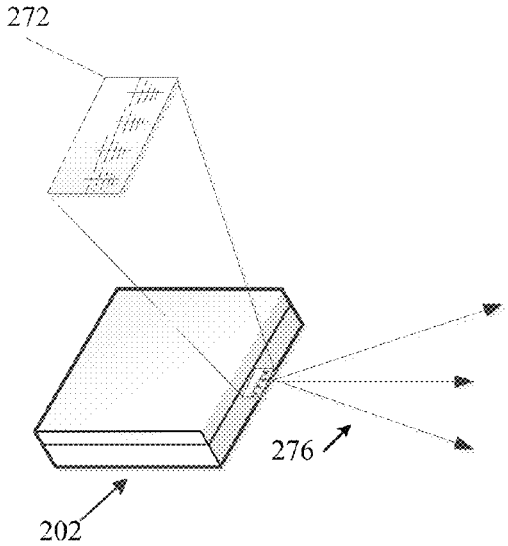

Reference is made to FIGS. 2A and 2B, which schematically illustrate a notebook 202 having a lid 214 and a base 216 at an open state (FIG. 2A) and a closed state (FIG. 2B), in accordance with some demonstrative embodiments. For example, notebook 202 may perform the functionality of mobile device 102 (FIG. 1), lid 214 may perform the functionality of lid 114 (FIG. 1) and/or base 216 may perform the functionality of base 116 (FIG. 1).

As shown in FIGS. 2A and 2B, lid 214 may be movable between two positions, e.g., an open position (FIG. 2A) and a closed position (FIG. 2B).

In some demonstrative embodiments, notebook 202 may include an antenna array 271 associated with lid 214, and an antenna array 272 associated with base 216. In other embodiments both antenna array 271 and antenna array 272 may be associated with lid 214 or base 216. Antenna arrays 271 and 272 may be configured to perform wireless communication with another device, e.g., device 104 (FIG. 1).

In some demonstrative embodiments, antenna array 271 may include a rectangular array of patch antenna elements, and/or antenna array 272 may include a linear array with endfire antennas.

In some demonstrative embodiments, controller 112 (FIG. 1) may select antenna array 271 to perform the wireless communication when lid 214 is in the open position, and controller 112 (FIG. 1) may select antenna array 272 to perform the wireless communication when lid 214 is in the closed position.

As shown in FIG. 2A, when lid 214 is in the open position, controller 112 (FIG. 1) may select antenna array 271 to perform the wireless communication.

In some demonstrative embodiments, antenna array 271 may be configured to create a beam in a direction 275 perpendicular to antenna array 271.

As shown in FIG. 2A, device 202 may utilize antenna array 271 to communicate in direction 275 substantially perpendicular to lid 214.

As shown in FIG. 2B, when lid 214 is in the closed position, controller 112 (FIG. 1) may select antenna array 272, to perform the wireless communication.

In some demonstrative embodiments, antenna array 272 may be configured to create a beam in a direction 276 parallel to antenna array 272.

As shown in FIG. 2B, the wireless communication via antenna array 272 may be preformed in direction 276 substantially parallel to base 216.

As shown in FIGS. 2A and 2B, direction 275 and direction 276 may be directed substantially to the same absolute direction, e.g., to maintain connectivity to device 104 (FIG. 1), for example, when device 202 is in the open and the closed states.

Although the conceptual illustrations of FIGS. 2A and 2B depict a rectangular array of patch antenna elements, and a linear array of endfire antenna elements, in other embodiments device 202 may include any other different types of antennas associated with the lid and/or the base of device 202, e.g., any suitable directional antennas.

Figure 3A:
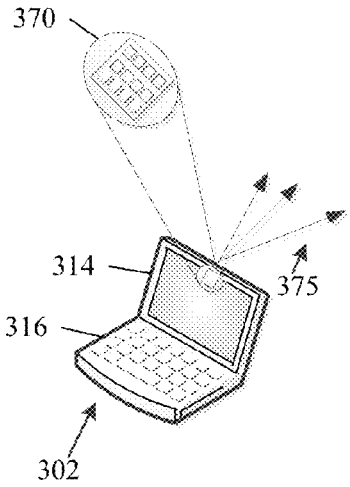
FIGS. 3A and 3B are illustrations of another mobile device in closed and open states, in accordance with some demonstrative embodiments.
Figure 3B:
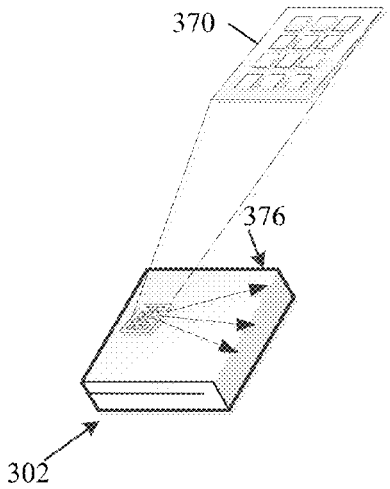

Reference is made to FIGS. 3A and 3B, which schematically illustrate a notebook 302 having a lid 314 and a base 316 at the open state (FIG. 3A) and the closed state (FIG. 3B), e.g., in accordance with some demonstrative embodiments. For example, notebook 302 may perform the functionality of mobile device 102 (FIG. 1), lid 314 may perform the functionality of lid 114 (FIG. 1) and/or base 316 may perform the functionality of base 116 (FIG. 1).

As shown in FIGS. 3A and 3B, lid 314 may be movable between two positions, e.g., an open position (FIG. 3A) and a closed position (FIG. 3B).

In some demonstrative embodiments, notebook 302 may include an antenna array 370 associated with lid 314 to perform wireless communication with another device, e.g., device 104 (FIG. 1). For example, antenna array 370 may include a rectangular array of patch antenna elements In some demonstrative embodiments, controller 112 (FIG. 1) may select a first directionality 375 of antenna array 370 to perform the wireless communication when lid 314 is in the open position, and controller 112 (FIG. 1) may select a second directionality 376 of antenna array 370 to perform the wireless communication when lid 314 is in the closed position.

As shown in FIG. 3A, when lid 314 is in the open position, controller 112 (FIG. 1) may select a first antenna directionality 375 for antenna array 370 to perform the wireless communication.

In some demonstrative embodiments, antenna array 370 may be configured to create a beam in first antenna directionality 375.

As shown in FIG. 3A, first antenna directionally 375 may include a direction substantially perpendicular to antenna array 370.

As shown in FIG. 3B, when lid 314 is in the closed position, controller 112 (FIG. 1) may select second antenna directionality 376 for antenna array 370, to perform the wireless communication.

In some demonstrative embodiments, antenna array 370 may be configured to create a beam in second antenna directionality 376.

As shown in FIG. 3B, second antenna directionally 376 may include a direction substantially parallel to antenna array 370.

In some demonstrative embodiments, controller 112 (FIG. 1) may change the directionality of antenna array 370, for example, by shifting phases on the one or more antenna elements of antenna array 370.

For example, shifting the phase states of the antenna elements, e.g., by one or more phase shifters, may provide a constructive and/or destructive interference, configured to change the directionality of antenna array 370.

As shown in FIGS. 3A and 3B, direction 375 and direction 376 may be directed substantially to the same absolute direction, e.g., to maintain connectivity to device 104 (FIG. 1), for example, when device 302 is in the open and the closed states.

Although the conceptual illustrations of FIGS. 3A and 3B depict a rectangular array of patch antenna elements, configured to be switchable between two antenna directionality states, in other embodiments device 302 may include any other different type of antennas, e.g., endfire antennas and/or the like, switched between any other operational states. For example, controller 112 (FIG. 1) may switch an antenna between on and off states, two transmission power states and the like.

In some demonstrative embodiments, controller 112 (FIG. 1) may be configured to switch between more than two operational states of an antenna, for example, three or more transmission powers.

Figure 4A:
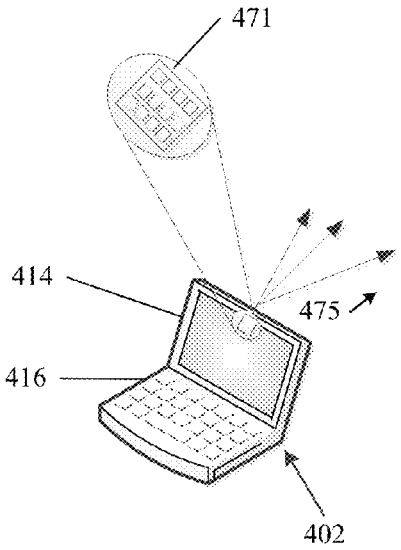
FIGS. 4A and 4B are illustrations of another mobile device having a detachable lid in open and detached states, in accordance with some demonstrative embodiments.
Figure 4B:
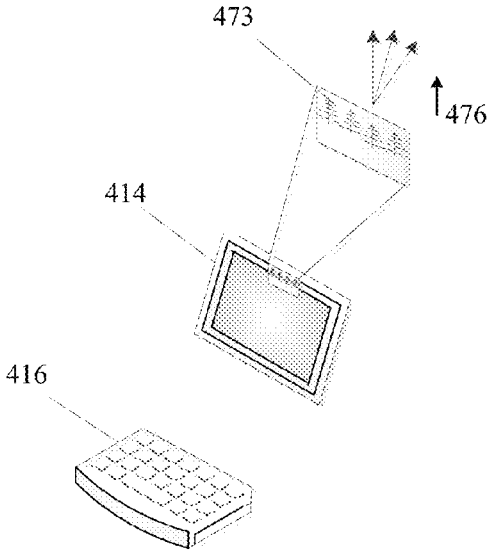

Reference is made to FIGS. 4A and 4B, which schematically illustrate a notebook 402 having a detachable lid 414 and a base 416, in accordance with some demonstrative embodiments. For example, notebook 402 may perform the functionality of mobile device 102 (FIG. 1), detachable lid 414 may perform the functionality of lid 114 (FIG. 1) and/or base 416 may perform the functionality of base 116 (FIG. 1).

In some demonstrative embodiments, notebook 402 may perform the functionality of a notebook having a detachable display, and detachable lid 414 may perform the functionality of a tablet computer, e.g., having a touch screen, an onscreen virtual keyboard, a battery and/or the like.

In some demonstrative embodiments, detachable lid 114 may be configured to work as a separate device, e.g., fully operated while separated from base 116.

As shown in FIGS. 4A and 4B, device 402 may have two different working states, e.g., a notebook state (FIG. 4A) and a tablet state (FIG. 4B).

As shown in FIGS. 4A and 4B, detachable lid 414 may be movable between two positions relative to base 416, e.g., an open position (FIG. 4A) and a detached position (FIG. 4B).

In some demonstrative embodiments, lid 414 may include an antenna array 471 and an antenna array 473. Antenna arrays 471 and 473 may be configured to perform wireless communication with another device, e.g., device 104 (FIG. 1).

In some demonstrative embodiments, antenna array 471 may include a rectangular array of patch antenna elements 471, and antenna array 473 may include a linear array with endfire antennas.

In some demonstrative embodiments, controller 112 (FIG. 1) may select antenna array 471 to perform the wireless communication when detachable lid 414 is in the open position, and controller 112 (FIG. 1) may select antenna array 473 to perform the wireless communication when lid 414 is in the detached position, e.g., detached from base 416.

As shown in FIG. 4A, when detachable lid 414 is in the open position, controller 112 (FIG. 1) may select antenna array 471 to perform the wireless communication.

In some demonstrative embodiments, antenna array 471 may be configured to create a beam in a direction 475 perpendicular to antenna array 471.

As shown in FIG. 4A, notebook 402 may utilize antenna array 471 to communicate in direction 475 substantially perpendicular to detachable lid 414.

In some demonstrative embodiments, when detachable lid 414 is in the detached position, controller 112 (FIG. 1) may select antenna array 473 to perform the wireless communication.

In some demonstrative embodiments, antenna array 473 may be configured to create a beam in a direction 476 parallel to antenna array 473.

As shown in FIG. 4B, notebook 402 may utilize antenna array 473 to communicate in direction 476 substantially parallel to detachable lid 414.

Figure 5A:
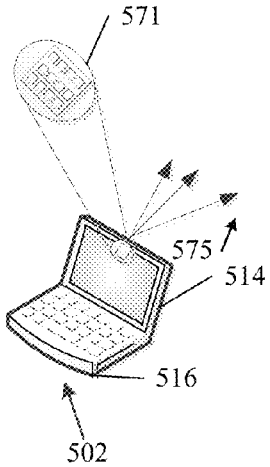
FIGS. 5A, 5B and 5C are illustrations of another mobile device having a swivel lid in three states, in accordance with some demonstrative embodiments.
Figure 5B:
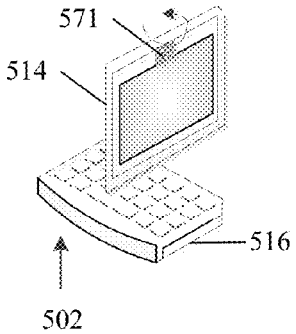
Figure 5C:
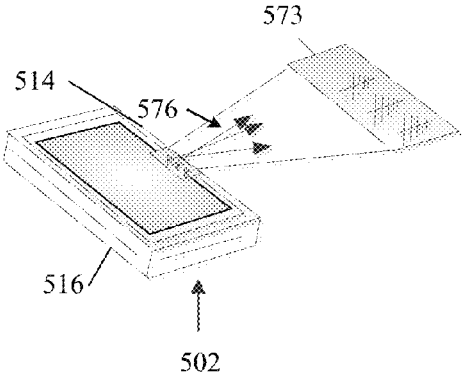

Reference is made to FIGS. 5A, 5B and 5C, which schematically illustrate a notebook 502 having a swivel lid 514 and a base 516, in accordance with some demonstrative embodiments. For example, notebook 502 may perform the functionality of mobile device 102 (FIG. 1), swivel lid 514 may perform the functionality of lid 114 (FIG. 1) and/or base 516 may perform the functionality of base 116 (FIG. 1).

In some demonstrative embodiments, notebook 502 may perform the functionality of a tablet PC, e.g., having a touch screen, an onscreen virtual keyboard, and/or the like.

In some demonstrative embodiments, swivel lid 514 may be configured to be rotated with respect to two axes, e.g., an axis connecting between lid 514 and base 516, and an axis perpendicular to base 516.

As shown in FIGS. 5A, 5B and 5C, device 502 may have three different working states, e.g., a notebook state (FIG. 5A), a swivel state (FIG. 5B) and a tablet PC state (FIG. 5C).

As shown in FIGS. 5A, 5B and 5C, swivel lid 514 may be movable between three positions relative to base 516, e.g., an open position (FIG. 5A), a swivel position (FIG. 5B) and a folded position (FIG. 5C).

In some demonstrative embodiments, swivel lid 514 may include an antenna array 571 and an antenna array 573. Antenna arrays 571 and 573 may be configured to perform wireless communication with another device, e.g., device 104 (FIG. 1).

In some demonstrative embodiments, antenna array 571 may include a rectangular array of patch antenna elements, and antenna array 573 may include a linear array with endfire antennas.

In some demonstrative embodiments, controller 112 (FIG. 1) may select antenna array 571 to perform the wireless communication when swivel lid 514 is in the open position and in the swivel position, controller 112 (FIG. 1) may select antenna array 573 to perform the wireless communication when swivel lid 514 is in the folded position.

As shown in FIG. 5A, when swivel lid 514 is in the open position, controller 112 (FIG. 1) may select antenna array 571 to perform the wireless communication.

As shown in FIG. 5B, swivel lid 514 may be in the swivel state, e.g., rotated along the axis perpendicular to base 516. For example, a display of swivel lid 514 may be facing away from base 116, e.g., to enable a user sitting behind notebook 502 to watch the display of notebook 502.

In some demonstrative embodiments, antenna array 571 may be configured to create a beam in a direction 575 perpendicular to antenna array 571.

As shown in FIG. 5A, notebook 502 may communicate via antenna array 571 in direction 575 substantially perpendicular to swivel lid 514.

As shown in FIG. 5C, when swivel lid 514 is in the folded position, controller 112 (FIG. 1) may select antenna array 573 to perform the wireless communication.

In some demonstrative embodiments, antenna array 573 may be configured to create a beam in a direction 576 parallel to antenna array 573.

As shown in FIG. 5C, notebook 502 may communicate via antenna array 573 in direction 576 substantially parallel to swivel lid 514.

Figure 6:
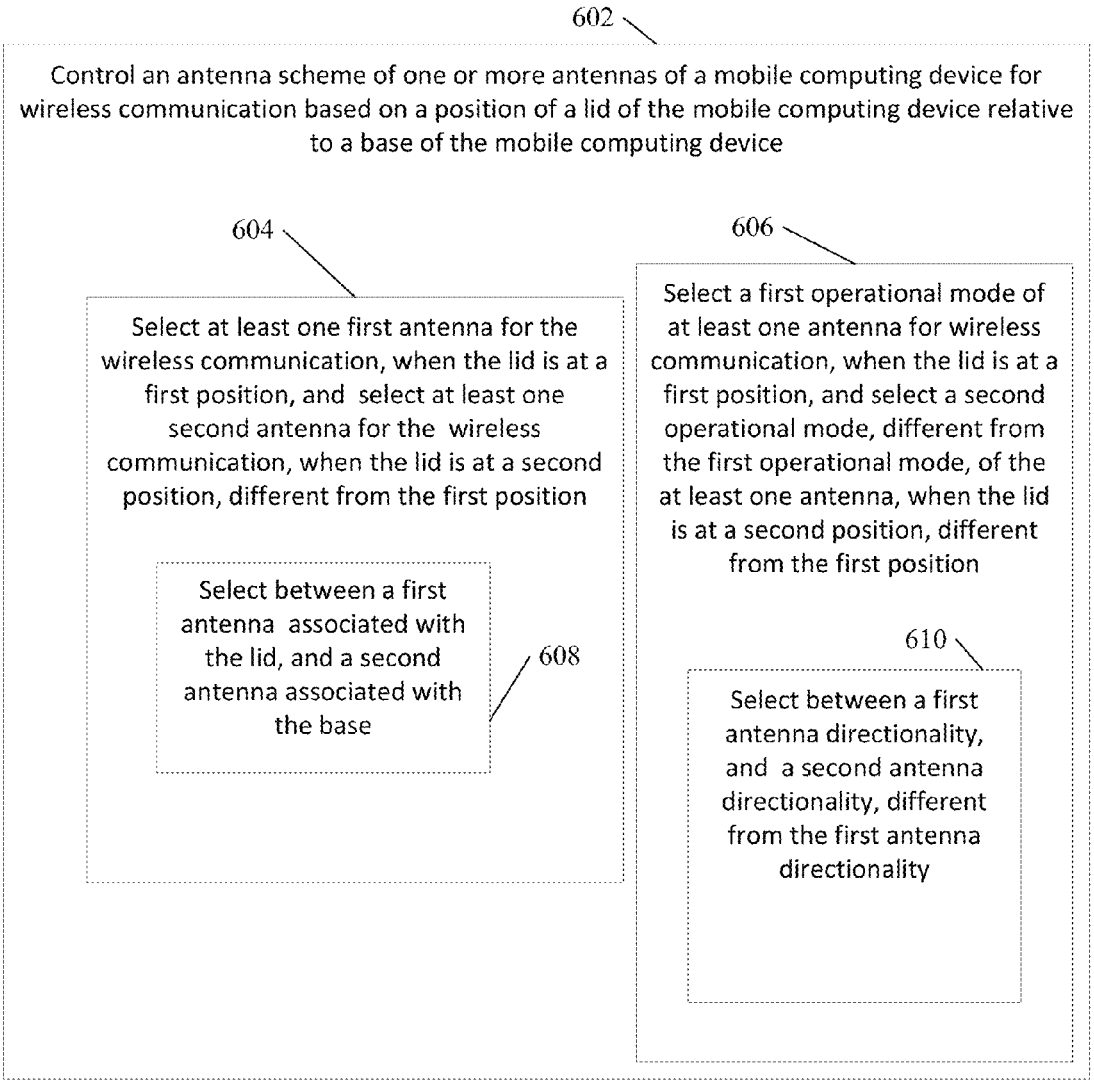
FIG. 6 is a schematic flow-chart illustration of a method of controlling one or more antennas of a wireless mobile device, in accordance with some demonstrative embodiments.

Reference is made to FIG. 6, which schematically illustrates a method of controlling one or more antennas of a mobile device, in accordance with some demonstrative embodiments. In some embodiments, one or more of the operations of the method of FIG. 6 may be performed by a wireless communication system, e.g., system 100 (FIG. 1); a mobile device, e.g., device 102 (FIG. 1), a controller, e.g., controller 112 (FIG. 1); and/or a wireless communication unit, e.g., wireless communication unit 110 (FIG. 1).

As indicated at block 602, the method may include controlling an antenna scheme of one or more antennas of a mobile device for wireless communication based on a position of a lid of the mobile device relative to a base of the mobile device. For example, controller 112 (FIG. 1) may control the antenna scheme of antennas 107 (FIG. 1) based on a position of lid 114 (FIG. 1) relative to base 116 (FIG. 1), e.g., as described above.

As indicated at block 604, controlling the antenna scheme may include selecting at least one first antenna for wireless communication, when the lid is at a first position, and selecting at least one second antenna for wireless communication, when the lid is at a second position, different from the first position. For example, controller 112 (FIG. 1) may select first antenna 171 (FIG. 1) for wireless communication, when lid 114 (FIG. 1) is at the open position, and second antenna 172 (FIG. 1) for wireless communication, when lid 114 (FIG. 1) is at the closed position, e.g., as described above.

As indicated at block 608, selecting between the first antenna and the second antenna may include selecting between a first antenna associated with the lid, and a second antenna associated with the base. For example, controller 112 (FIG. 1) may select between first antenna 171 (FIG. 1) associated with lid 114 (FIG. 1), and second antenna 172 (FIG. 1) associated with base 116 (FIG. 1), e.g., as described above.

As indicated at block 606, controlling the antenna scheme may include selecting a first operational mode of at least one antenna of the one or more antennas for wireless communication, when the lid is at a first position, and selecting a second operational mode, different from the first operational mode, of the at least one antenna, when the lid is at a second position, different from the first position. For example, controller 112 (FIG. 1) may select the first operational mode of antenna 370 (FIG. 3) for wireless communication, when lid 314 (FIG. 3) is in the open position, and the second operational mode of antenna 370 (FIG. 3) for wireless communication, when lid 314 (FIG. 3) is in the closed position, e.g., as described above.

As indicated at block 610, selecting between the first and second operational modes may include selecting between a first operational mode including a first antenna directionality, and a second operational mode including a second antenna directionality, different from the first antenna directionality. For example, controller 112 (FIG. 1) may select the first operational mode of antenna 370 (FIG. 3) including first directionality 375 (FIG. 3) and the second operational mode of antenna 370 (FIG. 3) including second directionality 376 (FIG. 3), e.g., as described above.

Figure 7:
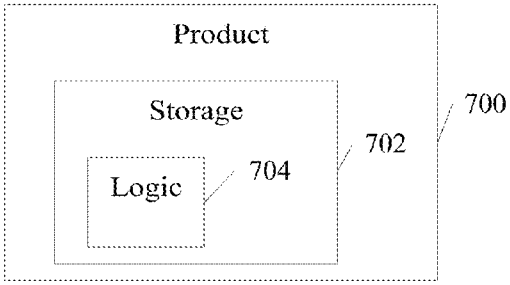
FIG. 7 is a schematic illustration of a product of manufacture, in accordance with some demonstrative embodiments.

Reference is made to FIG. 7, which schematically illustrates a product of manufacture 700, in accordance with some demonstrative embodiments. Product 700 may include a non-transitory machine-readable storage medium 702 to store logic 704, which may be used, for example, to perform at least part of the functionality of device 102 (FIG. 1), wireless communication unit 110 (FIG. 1), and/or controller 112 (FIG. 1) and/or to perform one or more operations of the method of FIG. 6. The phrase "non-transitory machine-readable medium" is directed to include all computer-readable media, with the sole exception being a transitory propagating signal.

In some demonstrative embodiments, product 700 and/or machine-readable storage medium 702 may include one or more types of computer-readable storage media capable of storing data, including volatile memory, non-volatile memory, removable or non-removable memory, erasable or non-erasable memory, writeable or re-writeable memory, and the like. For example, machine-readable storage medium 702 may include, RAM, DRAM, Double-Data-Rate DRAM (DDR-DRAM), SDRAM, static RAM (SRAM), ROM, programmable ROM (PROM), erasable programmable ROM (EPROM), electrically erasable programmable ROM (EEPROM), Compact Disk ROM (CD-ROM), Compact Disk Recordable (CD-R), Compact Disk Rewriteable (CD-RW), flash memory (e.g., NOR or NAND flash memory), content addressable memory (CAM), polymer memory, phase-change memory, ferroelectric memory, silicon-oxide-nitride-oxide-silicon (SONOS) memory, a disk, a floppy disk, a hard drive, an optical disk, a magnetic disk, a card, a magnetic card, an optical card, a tape, a cassette, and the like. The computer-readable storage media may include any suitable media involved with downloading or transferring a computer program from a remote computer to a requesting computer carried by data signals embodied in a carrier wave or other propagation medium through a communication link, e.g., a modem, radio or network connection.

In some demonstrative embodiments, logic 704 may include instructions, data, and/or code, which, if executed by a machine, may cause the machine to perform a method, process and/or operations as described herein. The machine may include, for example, any suitable processing platform, computing platform, computing device, processing device, computing system, processing system, computer, processor, or the like, and may be implemented using any suitable combination of hardware, software, firmware, and the like.

In some demonstrative embodiments, logic 704 may include, or may be implemented as, software, a software module, an application, a program, a subroutine, instructions, an instruction set, computing code, words, values, symbols, and the like. The instructions may include any suitable type of code, such as source code, compiled code, interpreted code, executable code, static code, dynamic code, and the like. The instructions may be implemented according to a predefined computer language, manner or syntax, for instructing a processor to perform a certain function. The instructions may be implemented using any suitable high-level, low-level, object-oriented, visual, compiled and/or interpreted programming language, such as C, C++, Java, BASIC, Matlab, Pascal, Visual BASIC, assembly language, machine code, and the like.

Functions, operations, components and/or features described herein with reference to one or more embodiments, may be combined with, or may be utilized in combination with, one or more other functions, operations, components and/or features described herein with reference to one or more other embodiments, or vice versa.

While certain features of the invention have been illustrated and described herein, many modifications, substitutions, changes, and equivalents may occur to those skilled in the art. It is, therefore, to be understood that the appended claims are intended to cover all such modifications and changes as fall within the true spirit of the invention.

What is claimed is:

1. An apparatus comprising:

a controller component configured to control an antenna scheme of one or more antennas of a mobile device for wireless communication based on a position of a lid of said mobile device relative to a base of said mobile device, said controller component is configured to select a first operational mode of at least one antenna of said one or more antennas for wireless communication, when said lid is at a first position, and to select a second operational mode, different from said first operational mode, of said at least one antenna, when said lid is at a second position, different from said first position, said first operational mode comprises a first antenna directionality of said at least one antenna, and said second operational mode comprises a second antenna directionality of said at least one antenna, different from said first antenna directionality, said at least one antenna comprises an antenna on the lid, said controller component is to select at least one first antenna for wireless communication, when said lid is at said first position, and to select at least one second antenna for wireless communication, when said lid is at said second position.

2. The apparatus of claim 1, wherein said at least one first antenna is associated with said lid, and wherein said at least one second antenna is associated with said base.

3. The apparatus of claim 1, wherein said first and second antennas comprise antennas of first and second different types.

4. The apparatus of claim 3, wherein said first antenna comprises a rectangular array of patch antenna elements, and wherein said second antenna comprises a linear array of end-fire antenna elements.

5. The apparatus of claim 1, wherein said at least one antenna comprises an antenna array, wherein said first antenna directionality is substantially perpendicular to said second antenna directionality.

6. The apparatus of claim 1, wherein said first position comprises an open lid position, and said second position comprises a closed lid position.

7. The apparatus of claim 1, wherein said first position of said lid comprises a detached position, in which said lid is detached from said base.

8. The apparatus of claim 1, wherein said lid comprises a swivel lid, and wherein said first position comprises a notebook position, in which said swivel lid is rotated with respect to said base, and said second position comprises a tablet position, in which said swivel lid is folded over said base.

9. A mobile device comprising:

a base;

a lid movable between at least first and second positions with respect to said base;

a sensor to sense a position of said lid relative to said base;

one or more antennas; and a controller component configured to control an antenna scheme of at least one antenna of said one or more antennas for wireless communication, based on the position of said lid, said controller component is configured to select a first operational mode of at least one antenna of said one or more antennas for wireless communication, when said lid is at a first position, and to select a second operational mode, different from said first operational mode, of said at least one antenna, when said lid is at a second position, different from said first position, said first operational mode comprises a first antenna directionality of said at least one antenna, and said second operational mode comprises a second antenna directionality of said at least one antenna, different from said first antenna directionality, said at least one antenna comprises an antenna on the lid, said controller component is to select at least one first antenna of said one or more antennas for wireless communication, when said lid is at said first position, and to select at least one second antenna of said one or more antennas for wireless communication, when said lid is at said second position.

10. The mobile device of claim 9, wherein said at least one first antenna is associated with said lid, and wherein said at least one second antenna is associated with said base.

11. The mobile device of claim 9, wherein said first and second antennas comprise antennas of first and second different types.

12. The mobile device of claim 11, wherein said first antenna comprises a rectangular array of patch antenna elements, and wherein said second antenna comprises a linear array of end-fire antenna elements.

13. The mobile device of claim 9, wherein said first position comprises an open lid position, and said second position comprises a closed lid position.

14. The mobile device of claim 9, wherein said first position of said lid comprises a detached position, in which said lid is detached from said base.

15. The mobile device of claim 9, wherein said at least one antenna comprises an antenna array, wherein said first antenna directionality is substantially perpendicular to said second antenna directionality.

16. A method comprising:

controlling an antenna scheme of one or more antennas of a mobile device for wireless communication based on a position of a lid of said mobile device relative to a base of said mobile device, said controlling comprises selecting a first operational mode of at least one antenna of said one or more antennas for wireless communication, when said lid is at a first position, and selecting a second operational mode, different from said first operational mode, of said at least one antenna, when said lid is at a second position, different from said first position, said first operational mode comprises a first antenna directionality of said at least one antenna, and said second operational mode comprises a second antenna directionality of said at least one antenna, different from said first antenna directionality, said at least one antenna comprises an antenna on the lid, said controlling comprises selecting at least one first antenna for wireless communication, when said lid is at said first position, and selecting at least one second antenna for wireless communication, when said lid is at said second position.

17. The method of claim 16, wherein said at least one first antenna is associated with said lid, and wherein said at least one second antenna is associated with said base.

18. The method of claim 16, wherein said first and second antennas comprise antennas of first and second different types.

19. The method of claim 16, wherein said first position comprises an open lid position, and said second position comprises a closed lid position.

20. The method of claim 16, wherein said first position of said lid comprises a detached position, in which said lid is detached from said base.

21. A product including a non-transitory storage medium having stored thereon instructions that, when executed by a machine, result in:

controlling an antenna scheme of one or more antennas of a mobile device for wireless communication based on a position of a lid of said mobile device relative to a base of said mobile device, said controlling comprises selecting a first operational mode of at least one antenna of said one or more antennas for wireless communication, when said lid is at a first position, and selecting a second operational mode, different from said first operational mode, of said at least one antenna, when said lid is at a second position, different from said first position, said first operational mode comprises a first antenna directionality of said at least one antenna, and said second operational mode comprises a second antenna directionality of said at least one antenna, different from said first antenna directionality, said at least one antenna comprises an antenna on the lid, said controlling comprises selecting at least one first antenna for wireless communication, when said lid is at said first position, and selecting at least one second antenna for wireless communication, when said lid is at said second position.

22. The product of claim 21, wherein said first position comprises an open lid position, and said second position comprises a closed lid position.

* * * * *